US011040544B2

(12) United States Patent
Bandoh

(10) Patent No.: US 11,040,544 B2
(45) Date of Patent: Jun. 22, 2021

(54) LIQUID DISCHARGE HEAD, HEAD MODULE, HEAD UNIT, LIQUID DISCHARGE DEVICE, AND LIQUID DISCHARGE APPARATUS

(71) Applicant: Yoshinori Bandoh, Kanagawa (JP)

(72) Inventor: Yoshinori Bandoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/819,607

(22) Filed: Mar. 16, 2020

(65) Prior Publication Data

US 2020/0298582 A1 Sep. 24, 2020

(30) Foreign Application Priority Data

Mar. 20, 2019 (JP) ..... JP2019-052218

(51) Int. Cl.
*B41J 2/175* (2006.01)
*B41J 2/18* (2006.01)
*B41J 2/14* (2006.01)

(52) U.S. Cl.
CPC ..... *B41J 2/17563* (2013.01); *B41J 2/14145* (2013.01); *B41J 2/18* (2013.01);
(Continued)

(58) Field of Classification Search
CPC ..... B41J 2/17563; B41J 2/14145; B41J 2/18; B41J 2002/14403; B41J 2202/12;
(Continued)

(56) References Cited

U.S. PATENT DOCUMENTS 8,684,507 B2 * 4/2014 Uezawa ..... B41J 2/14233 347/89
2011/0181670 A1 7/2011 Tsubaki
(Continued)

FOREIGN PATENT DOCUMENTS

JP 9-141890 * 6/1997 ..... B41J 2/175
JP 2011-148224 8/2011
(Continued)

*Primary Examiner* — Geoffrey S Mruk
(74) *Attorney, Agent, or Firm* — Oblon, McClelland, Maier & Neustadt, L.L.P.

(57) ABSTRACT

A liquid discharge head includes a plurality of pressure chambers, a plurality of individual supply channels, a plurality of common supply channel branches, a common supply channel mainstream, a plurality of individual collection channels, a plurality of common collection channel branches, a common collection channel mainstream, a supply-side filter, and a bypass channel. The common supply channel mainstream is communicated with the common supply channel branches. The common collection channel mainstream is communicated with the common collection channel branches. The supply-side filter is in the common supply channel mainstream. The bypass channel bypasses the supply-side filter and communicates the common supply channel mainstream with the common collection channel mainstream. The bypass channel is connected to the common supply channel mainstream at a downstream of the supply-side filter in a direction of flow of the liquid along a longitudinal direction of the common supply channel mainstream.

16 Claims, 13 Drawing Sheets

(52) U.S. Cl.
CPC .. *B41J 2/14233* (2013.01); *B41J 2002/14403* (2013.01); *B41J 2002/14419* (2013.01); *B41J 2002/14459* (2013.01); *B41J 2202/12* (2013.01)

(58) Field of Classification Search
CPC ..... B41J 2002/14419; B41J 2/14233; B41J 2002/14459
See application file for complete search history.

(56) References Cited

U.S. PATENT DOCUMENTS

| | | | |
|---|---|---|---|
| 2012/0062659 | A1 | 3/2012 | Tsubaki |
| 2013/0050346 | A1 | 2/2013 | Takeuchi et al. |
| 2014/0267499 | A1 | 9/2014 | Kato |
| 2017/0001441 | A1 | 1/2017 | Kato |
| 2017/0151782 | A1 | 6/2017 | Takahashi et al. |
| 2019/0270310 | A1 | 9/2019 | Masuda et al. |
| 2019/0275793 | A1 | 9/2019 | Kato |
| 2019/0275797 | A1 | 9/2019 | Kato |

FOREIGN PATENT DOCUMENTS

| | | |
|---|---|---|
| JP | 2011-161878 | 8/2011 |
| JP | 2012-056248 | 3/2012 |
| JP | 2012-218398 | 11/2012 |
| JP | 2013-067111 | 4/2013 |
| JP | 2014-141102 | 8/2014 |
| JP | 2015-085524 | 5/2015 |
| JP | 2016-128270 | 7/2016 |
| JP | 2017-013475 | 1/2017 |
| WO | WO2016/190349 A1 | 12/2016 |

* cited by examiner

LIQUID DISCHARGE HEAD, HEAD MODULE, HEAD UNIT, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2019-052218, filed on Mar. 20, 2019, in the Japan Patent Office, the entire disclosure of which is incorporated by reference herein.

BACKGROUND

Technical Field

Aspects of the present disclosure relate to a liquid discharge head, a head module, a head unit, a liquid discharge device, and a liquid discharge apparatus.

Related Art

In a liquid discharge head that discharges liquid, in order to prevent a nozzle from being clogged with foreign substances, a filter that removes the foreign substances is disposed in a common channel.

SUMMARY

In an aspect of the present disclosure, there is provided a liquid discharge head that includes a plurality of pressure chambers, a plurality of individual supply channels, a plurality of common supply channel branches, a common supply channel mainstream, a plurality of individual collection channels, a plurality of common collection channel branches, a common collection channel mainstream, a supply-side filter, and a bypass channel. The plurality of pressure chambers is communicated with a plurality of nozzles configured to discharge liquid, respectively. The plurality of individual supply channels is communicated with the plurality of pressure chambers, respectively. Each of the plurality of common supply channel branches is communicated with two or more individual supply channels of the plurality of individual supply channels. The common supply channel mainstream is communicated with the plurality of common supply channel branches. The plurality of individual collection channels is communicated with the plurality of pressure chambers, respectively. Each of the plurality of common collection channel branches is communicated with two or more individual collection channels of the plurality of individual collection channels. The common collection channel mainstream is communicated with the plurality of common collection channel branches. The supply-side filter is in the common supply channel mainstream. The bypass channel bypasses the supply-side filter and communicates the common supply channel mainstream with the common collection channel mainstream. The bypass channel is connected to the common supply channel mainstream at a downstream of the supply-side filter in a direction of flow of the liquid along a longitudinal direction of the common supply channel mainstream.

In another aspect of the present disclosure, there is provided a liquid discharge head that includes a plurality of pressure chambers, a common supply channel, a common collection channel, a supply-side filter, and a bypass channel. The plurality of pressure chambers is communicated with a plurality of nozzles configured to discharge liquid, respectively. The common supply channel is communicated with the plurality of pressure chambers. The common collection channel is communicated with the plurality of pressure chambers. The supply-side filter is in the common supply channel. The bypass channel bypasses the supply-side filter and communicates the common supply channel with the common collection channel. The bypass channel is connected to the common supply channel at a downstream of the supply-side filter in a direction of flow of the liquid along a longitudinal direction of the common supply channel.

In another aspect of the present disclosure, there is provided a head module that includes an array of a plurality of liquid discharge heads, including the liquid discharge head.

In another aspect of the present disclosure, there is provided a head unit that includes a plurality of head modules, including the head module, arranged side by side.

In another aspect of the present disclosure, there is provided a liquid discharge device that includes the liquid discharge head.

In another aspect of the present disclosure, there is provided a liquid discharge apparatus that includes one of the liquid discharge device, the head unit, the head module, and the liquid discharge head.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
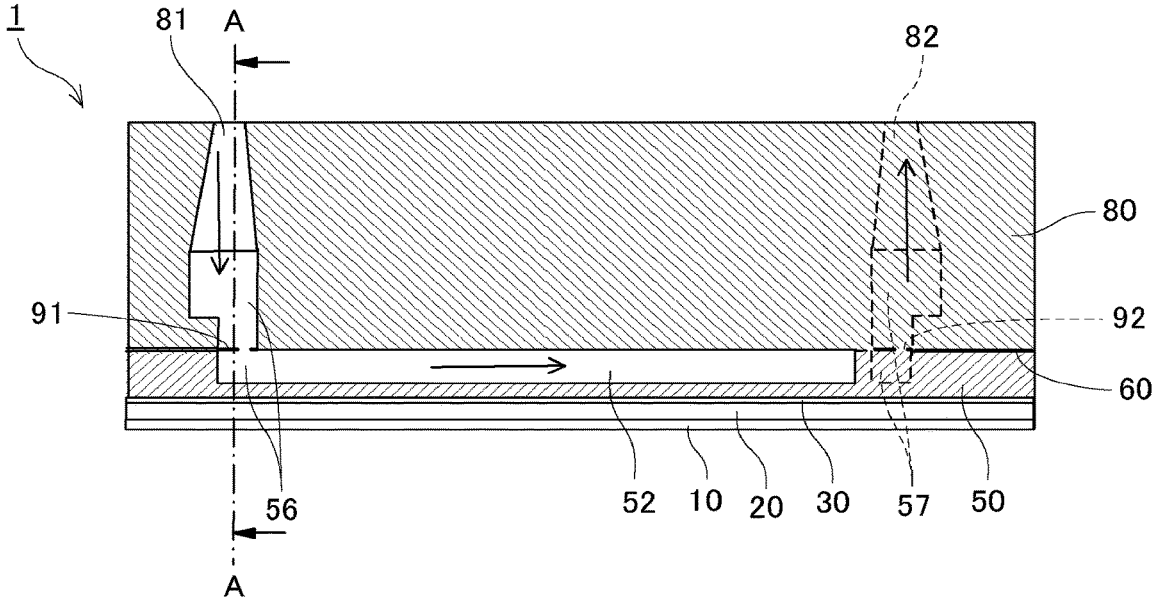
FIG. 1 is a cross-sectional illustrative view taken along line C-C in FIG. 3 of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
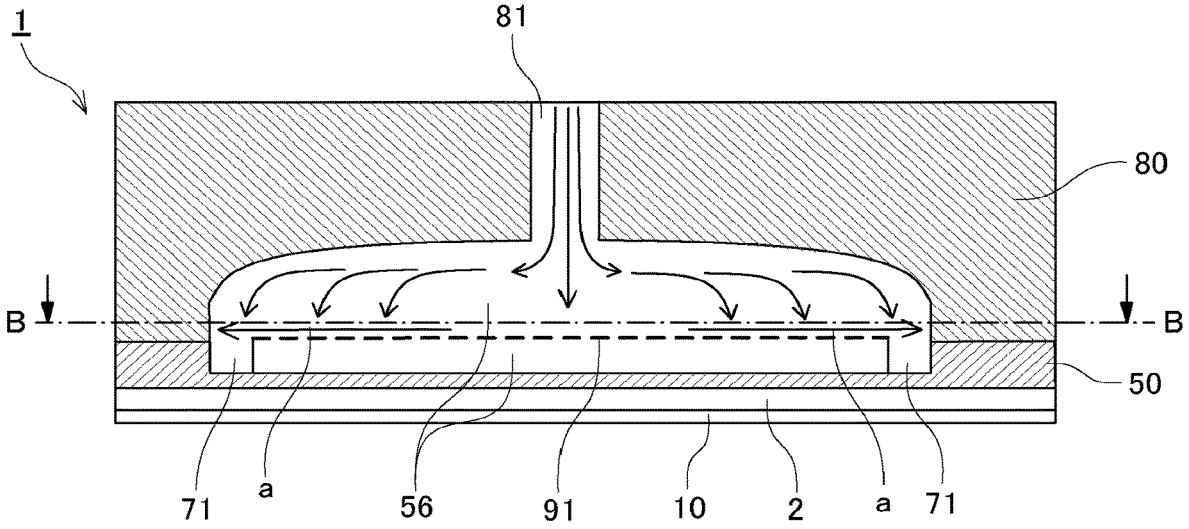
FIG. 2 is a cross-sectional illustrative view taken along line A-A in FIG. 1.
Figure 3:
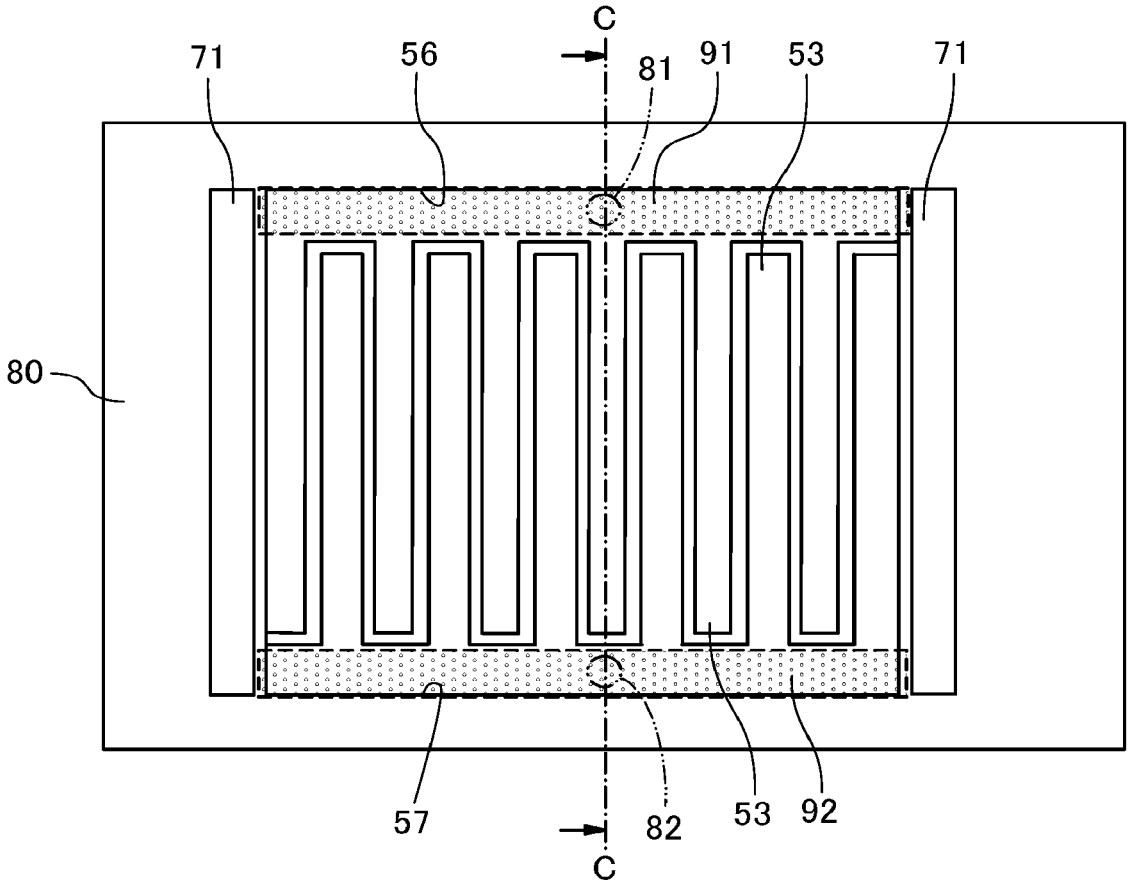
FIG. 3 is a plan illustrative view taken along line B-B in FIG. 2.
Figure 4:
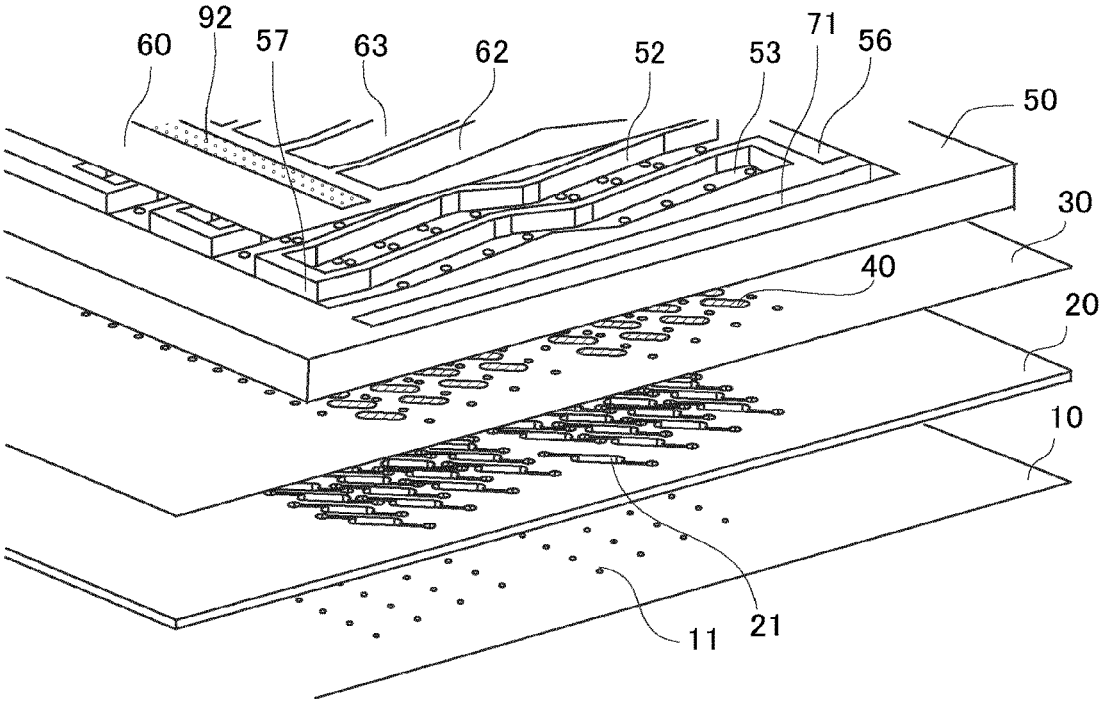
FIG. 4 is an exploded perspective illustrative view thereof without a frame member.
Figure 5:
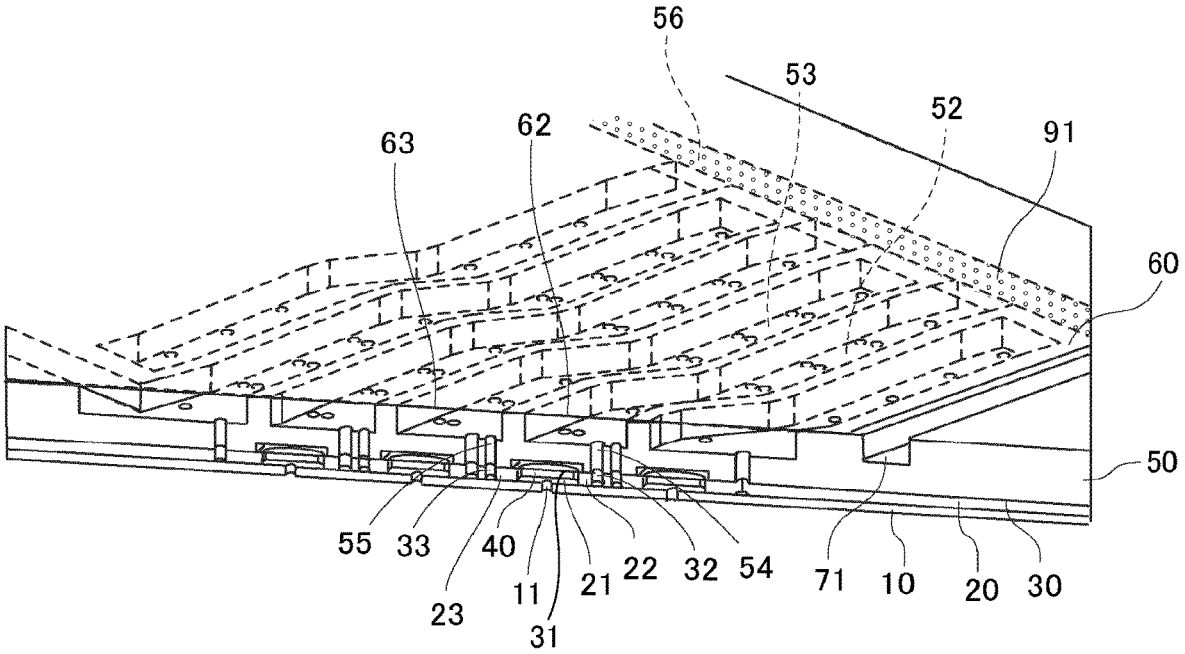
FIG. 5 is a cross-sectional perspective illustrative view of a channel thereof.
Figure 6:
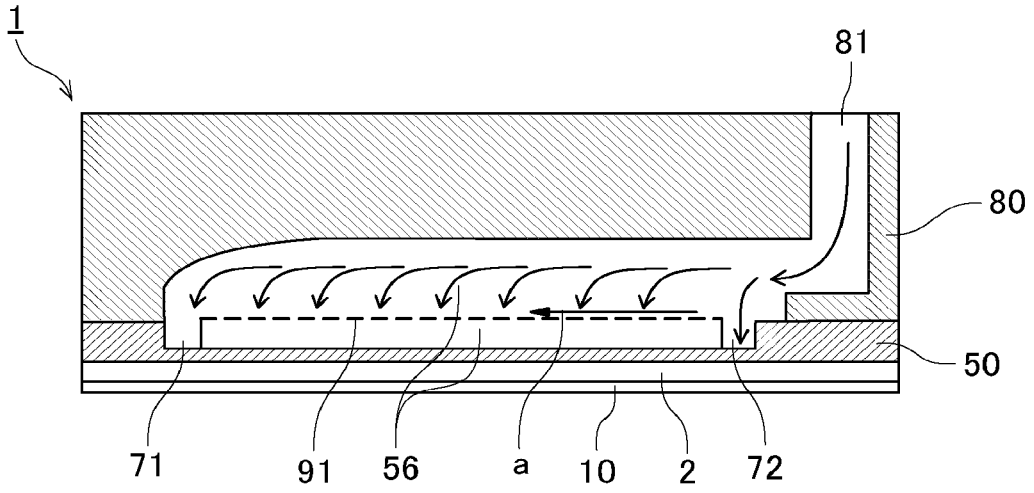
FIG. 6 is a cross-sectional illustrative view similar to FIG. 2 of a liquid discharge head according to a second embodiment of the present disclosure.

A first embodiment of the present disclosure is described with reference to FIGS. 1 to 5. FIG. 1 is a cross-sectional illustrative view in a lateral direction of a common channel corresponding to line C-C in FIG. 3 of a liquid discharge head according to this embodiment, FIG. 2 is a cross-sectional illustrative view taken along line A-A in FIG. 1, and FIG. 3 is a plan illustrative view taken along line B-B in FIG. 2. FIG. 5 is an exploded perspective illustrative view illustrating an example of a specific configuration of a channel portion, and FIG. 6 is a cross-sectional perspective illustrative view of the channel portion.

A liquid discharge head 1 includes a nozzle plate 10, a channel plate (individual channel member) 20, a diaphragm member 30, a common channel member 50, a damper member 60, a frame member 80 and the like.

The nozzle plate 10 includes a plurality of nozzles 11 for discharging liquid. The plurality of nozzles 11 is arrayed in a two-dimensional matrix.

The individual channel member 20 forms a plurality of pressure chambers (individual liquid chambers) 21 communicating with the plurality of nozzles 11, respectively, a plurality of individual supply channels 22 communicating with the plurality of pressure chambers 21, respectively, and a plurality of individual collection channels 23 communicating with the plurality of pressure chambers 21, respectively.

The diaphragm member 30 forms a vibration region (diaphragm) 31 that is a deformable wall surface of the pressure chamber 21, and a piezoelectric element 40 is integrally provided in the vibration region 31. A supply-side opening 32 communicating with the individual supply channel 22 and a collection-side opening 33 communicating with the individual collection channel 23 are formed on the diaphragm member 30. The piezoelectric element 40 is a pressure generator that deforms the vibration region 31 to pressurize liquid in the pressure chamber 21.

The common channel member 50 forms a plurality of common supply channel branches 52 communicating with two or more individual supply channels 22 and a plurality of common collection channel branches 53 communicating with two or more individual collection channels 23.

In the common channel member 50, a through hole serving as a supply port 54 through which the supply-side opening 32 of the individual supply channel 22 and the common supply channel branch 52 communicate with each other, and a through hole serving as a collection port 55 through which a collection-side opening 33 of the individual collection channel 23 and the common collection channel branch 53 communicate with each other are formed.

The common channel member 50 forms a part of one or a plurality of common supply channel mainstreams 56 communicating with the plurality of common supply channel branches 52 and a part of one or a plurality of common collection channel mainstreams 57 communicating with the plurality of common collection channel branches 53. A remaining part of the common supply channel mainstream 56 and a remaining part of the common collection channel mainstream 57 are formed of the frame member 80.

A damper member 60 includes a supply-side damper 62 that faces (opposes to) the supply port 54 of the common supply channel branch 52, and a collection-side damper 63 that faces (opposes to) the collection port 55 of the common collection channel branch 53. The supply-side damper 62 forms a displaceable wall surface on a part of a wall surface of the common supply channel branch 52. The collection-side damper 63 forms a displaceable wall surface on a part of a wall surface of the common collection channel branch 53.

Here, the common supply channel branch 52 and the common collection channel branch 53 are formed by sealing grooves alternately arranged on the common channel member 50 being the same member by the supply-side damper 62 or the collection-side damper 63 of the damper member 60. As a damper material of the damper member 60, a metal thin film or an inorganic thin film resistant to an organic solvent is preferably used. A thickness of a portion of the supply-side damper 62 and the collection-side damper 63 of the damper member 60 is preferably 10 μm or less.

The damper member 60 forms a supply-side filter 91 disposed in the common supply channel mainstream 56 and a collection-side filter 92 disposed in the common collection channel mainstream 57. In order to prevent foreign substances from entering the nozzle, the supply-side filter 91 and the collection-side filter 92 have an opening diameter of a filter hole smaller than an opening diameter of the nozzle, for example.

A first bypass channel 71 is provided that bypasses the supply-side filter 91 and communicates the common supply channel mainstream 56 with the common collection channel mainstream 57.

The first bypass channel 71 is connected to the common supply channel mainstream 56 at a downstream of the supply-side filter 91 in a direction a of flow of the liquid (FIG. 2) (hereinafter "liquid flow direction") along a longitudinal direction of the common supply channel mainstream 56.

The first bypass channel 71 is connected to the common collection channel mainstream 57 in a region in which the collection-side filter 92 is not provided in the liquid flow direction a along the longitudinal direction of the common collection channel mainstream 57. That is, the first bypass channel 71 allows the common supply channel mainstream 56 and the common collection channel mainstream 57 to communicate with each other through a path that does not pass through the supply-side filter 91.

With such a configuration, bubbles included in the liquid supplied from a supply port 81 of the liquid discharge head 1 and bubbles generated at an upstream of the supply-side filter 91 of the common supply channel mainstream 56 reach the supply-side filter 91 or the first bypass channel 71 by liquid circulation.

The bubbles that reach the supply-side filter 91 cannot pass through the supply-side filter 91 sometimes depending on a size thereof and a pressure applied for the liquid circulation. At that time, the bubbles move further downstream by a flow in the common supply channel mainstream 56.

In this embodiment, the first bypass channel 71 is connected to the common supply channel mainstream 56 at the downstream of the supply-side filter 91 in the liquid flow direction a along the longitudinal direction of the common supply channel mainstream 56 while the liquid circulation is performed.

Therefore, the bubbles that cannot pass through the supply-side filter 91 may flow to the first bypass channel 71 with the liquid flow in the common supply channel mainstream 56.

In a case where the bubbles that cannot pass through the supply-side filter 91 accumulate on the supply-side filter 91, since an effective area of the supply-side filter 91 through which the liquid may pass decreases, resistance of the supply-side filter 91 increases, so that a circulating liquid flow rate decreases.

In this embodiment, the bubbles that cannot pass through the supply-side filter 91 move from the first bypass channel 71 to the common collection channel mainstream 57 and are discharged outside from a collection port 82, so that variation in circulation flow rate due to the accumulation of the bubbles on the supply-side filter 91 may be suppressed.

In this embodiment, since the collection-side filter 92 is also provided, in a case where a liquid circulating direction is reversed and the liquid is supplied from the collection port 82, the liquid supplied to the common collection channel branch 53 is supplied through the collection-side filter 92.

Even in a state in which a discharge flow rate increases and the liquid is supplied (reverses) to the pressure chamber via the collection-side filter 92, the bubbles that flow from the common supply channel mainstream 56 through the first bypass channel 71 to the common collection channel mainstream 57 remain on the collection-side filter 92 and it is possible to prevent the same from flowing to the common collection channel branch 53.

A minimum channel cross-sectional area of the first bypass channel 71 is preferably larger than a diameter of the supply-side filter 91 so that the bubbles that cannot pass through the supply-side filter 91 may easily flow.

Next, a second embodiment of the present disclosure is described with reference to FIG. 6. FIG. 6 is a cross-sectional illustrative view similar to FIG. 2 of a liquid discharge head according to this embodiment.

In this embodiment, a supply port 81 is disposed at an upstream of a supply-side filter 91 in a liquid flow direction a along a longitudinal direction of a common supply channel mainstream 56.

A first bypass channel 71 is provided to communicate the common supply channel mainstream 56 with a common collection channel mainstream 57.

The first bypass channel 71 is such that one end side is connected to the common supply channel mainstream 56 at a downstream of the supply-side filter 91 in the liquid flow direction a along the longitudinal direction of the common supply channel mainstream 56, and the other end side is connected to the common collection channel mainstream 57 as in the first embodiment.

As a result, bubbles that cannot pass through the supply-side filter 91 move from the first bypass channel 71 to the common collection channel mainstream 57 to be discharged outside from a collection port, so that variation in circulation flow rate due to accumulation of bubbles on the supply-side filter 91 may be suppressed.

A second bypass channel 72 is provided to allow the common supply channel mainstream 56 and the common collection channel mainstream 57 to communicate with each other.

The second bypass channel 72 is such that one end side is connected to the common supply channel mainstream 56 at the upstream of the supply-side filter 91 in the liquid flow direction a along the longitudinal direction of the common supply channel mainstream 56, and the other end side is connected to the common collection channel mainstream 57 as in the first embodiment.

As a result, the bubbles mixed in the liquid supplied from the supply port 81 to the common supply channel mainstream 56 pass through the second bypass channel 72 before reaching the supply-side filter 91 to move to the common collection channel mainstream 57 and is discharged outside.

Figure 7:
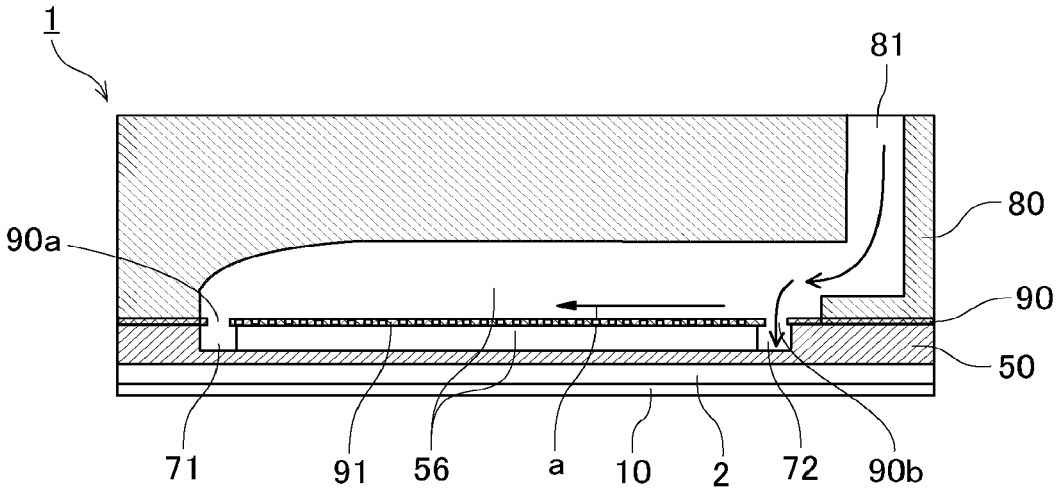
FIG. 7 is a cross-sectional illustrative view similar to FIG. 2 of a liquid discharge head according to a third embodiment of the present disclosure.
Figure 8:
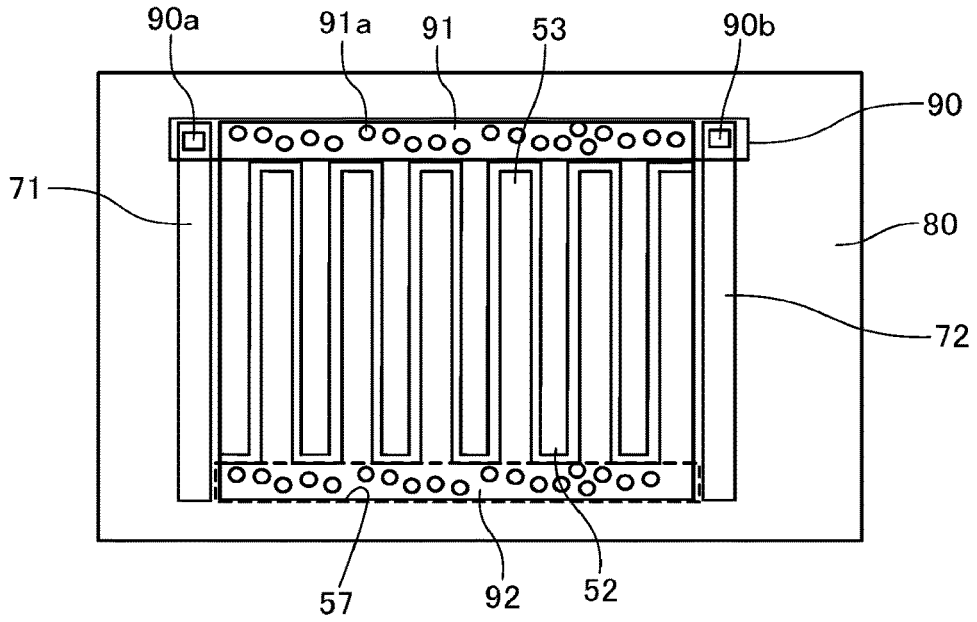
FIG. 8 is a plan illustrative view similar to FIG. 3.

Next, a third embodiment of the present disclosure is described with reference to FIGS. 7 and 8. FIG. 7 is a cross-sectional illustrative view similar to FIG. 2 of a liquid discharge head according to this embodiment, and FIG. 8 is a plan illustrative view similar to FIG. 3.

In this embodiment, a supply-side filter member 90 that forms a supply-side filter 91 is provided with an opening 90*a* communicating with a first bypass channel 71 along with a region provided with a large number of filter holes 91*a* forming the supply-side filter 91.

The opening 90*a* has an opening area larger than the opening area of the filter hole 91*a*. In this embodiment, the "supply-side filter" is formed of a large number of filter holes 91*a* formed on the supply-side filter member 90. In this configuration also, the first bypass channel 71 is connected to a common collection channel mainstream 57 at a downstream of a large number of filter holes 91*a* serving as the "supply-side filter".

Although the supply-side filter member 90 that forms the supply-side filter 91 is herein described, a collection-side filter member that forms the collection-side filter 92 may also be configured similarly.

Figure 9:
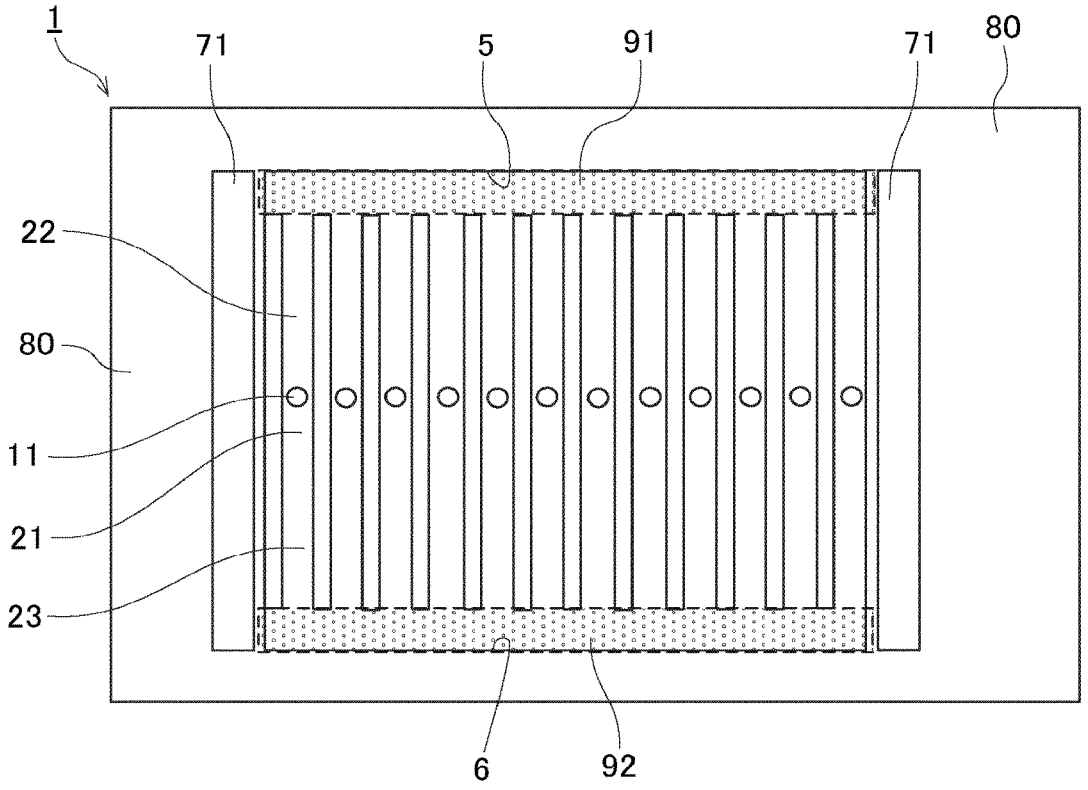
FIG. 9 is a plan illustrative view of a liquid discharge head according to a fifth embodiment of the present disclosure.

Next, a fourth embodiment of the present disclosure is described with reference to FIG. 9. FIG. 9 is a plan illustrative view of a liquid discharge head according to this embodiment.

In this embodiment, a common supply channel 5 communicates with a plurality of pressure chambers 21 via a plurality of individual supply channels 22, respectively. Similarly, a common collection channel 6 communicates with the plurality of pressure chambers 21 via a plurality of individual collection channels 23, respectively. That is, in this embodiment, a common channel is not separated into a mainstream and a branch.

In this embodiment also, a first bypass channel is connected to the common supply channel 5 at a downstream of a supply-side filter 91 in a liquid flow direction along a longitudinal direction of the common supply channel 5 as in the first embodiment.

As a result, effects similar to the effects of each of the embodiments described above may be obtained.

Figure 10:
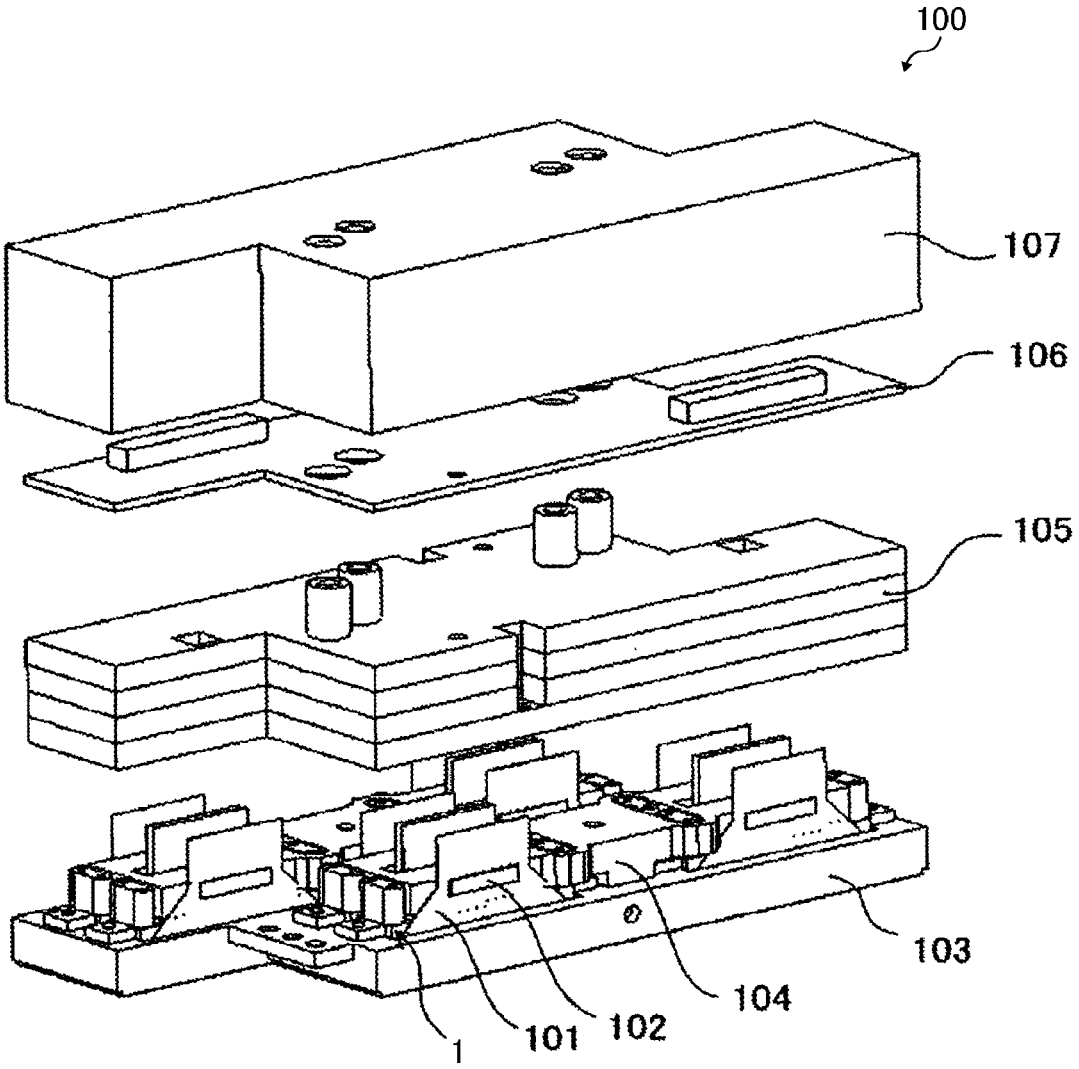
FIG. 10 is an exploded perspective illustrative view of an example of a head module according to an embodiment of the present disclosure.
Figure 11:
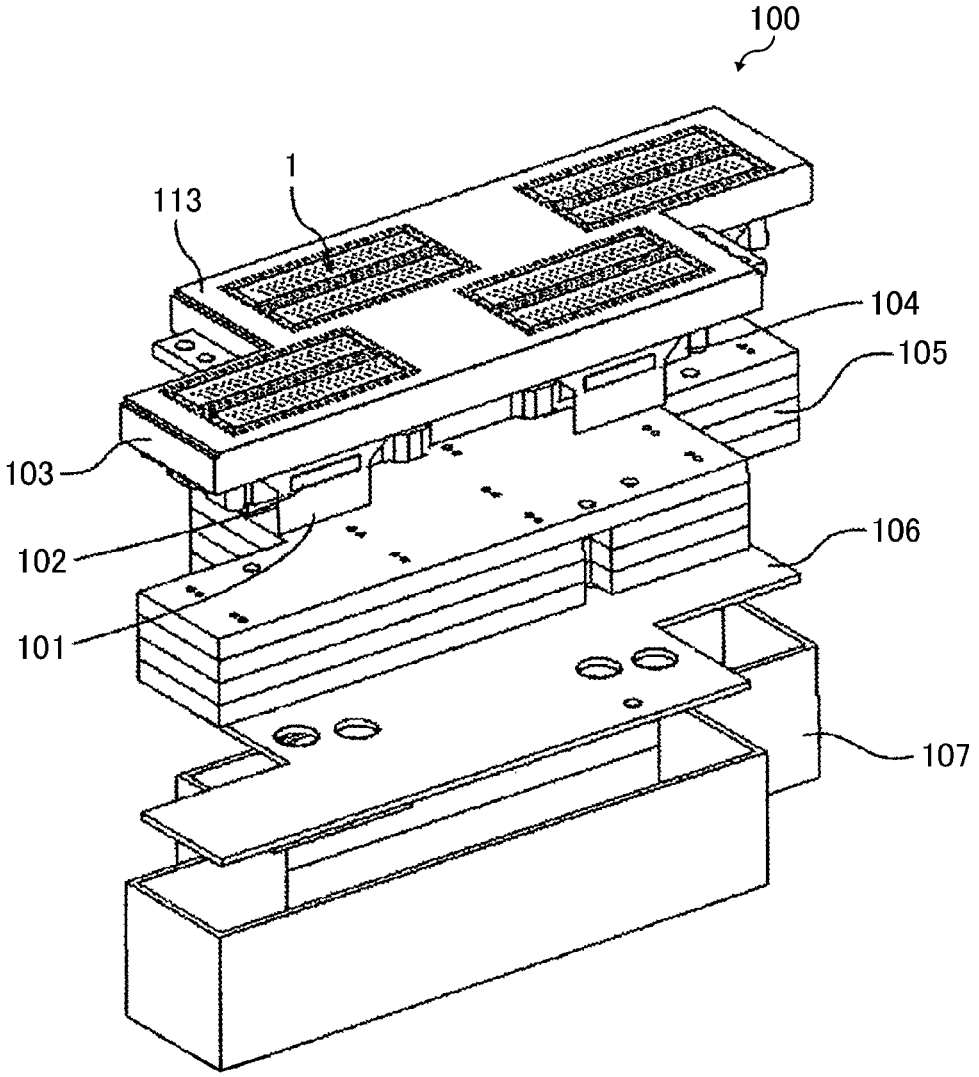
FIG. 11 is an exploded perspective illustrative view as seen from a nozzle surface side of the head module.

Next, a head module according to an embodiment of the present disclosure is described with reference to FIGS. 10 and 11. FIG. 10 is an exploded perspective illustrative view of the head module, and FIG. 11 is an exploded perspective illustrative view as seen from a nozzle surface side of the head module.

A head module 100 includes a plurality of heads 1 being liquid discharge heads that discharge liquid, a base member 103 that holds the plurality of heads 1, and a cover member 113 that serves as a nozzle cover of the plurality of heads 1.

The head module 100 also includes a heat radiating member 104, a manifold 105 that forms a channel for supplying liquid to the plurality of heads, a printed circuit board (PCB) 106 connected to a flexible wiring member 101, and a module case. 107.

Figure 12:
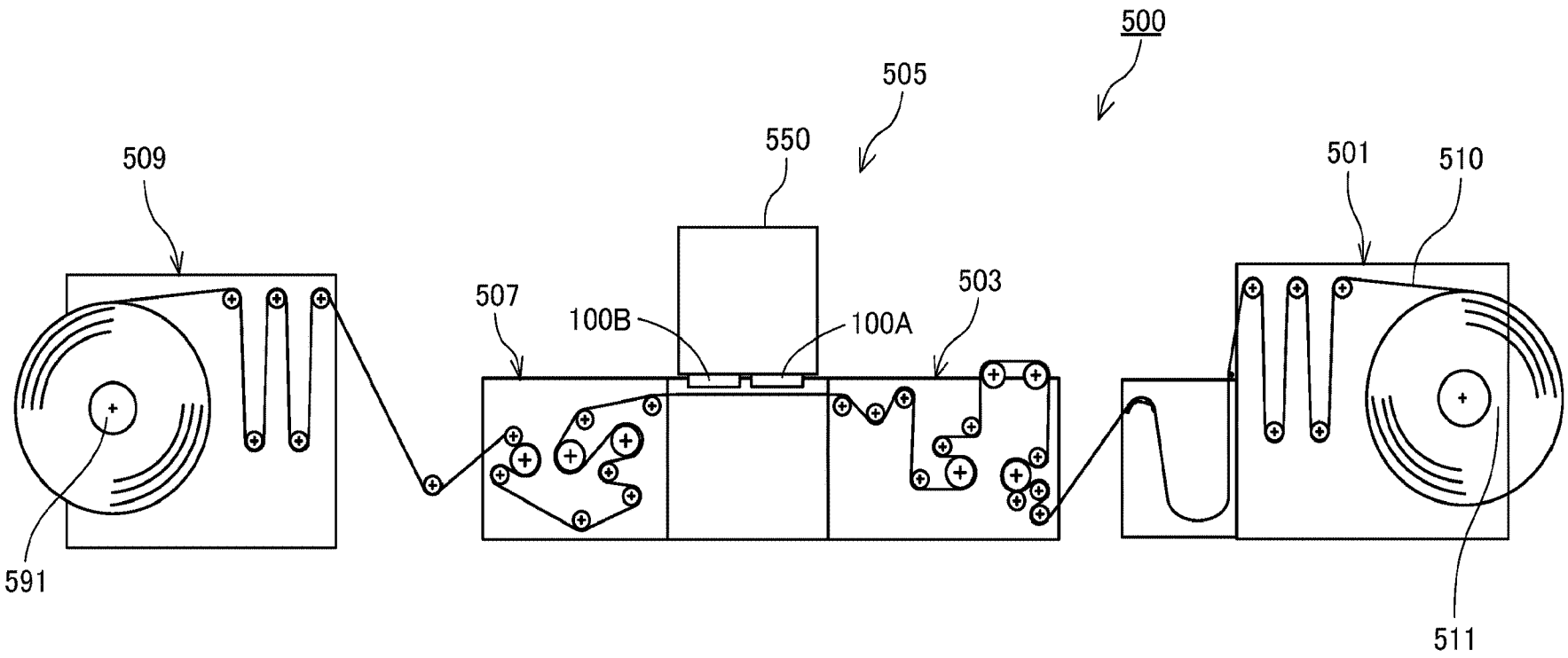
FIG. 12 is a schematic illustrative diagram of an example of a liquid discharge apparatus according to an embodiment of the present disclosure.
Figure 13:
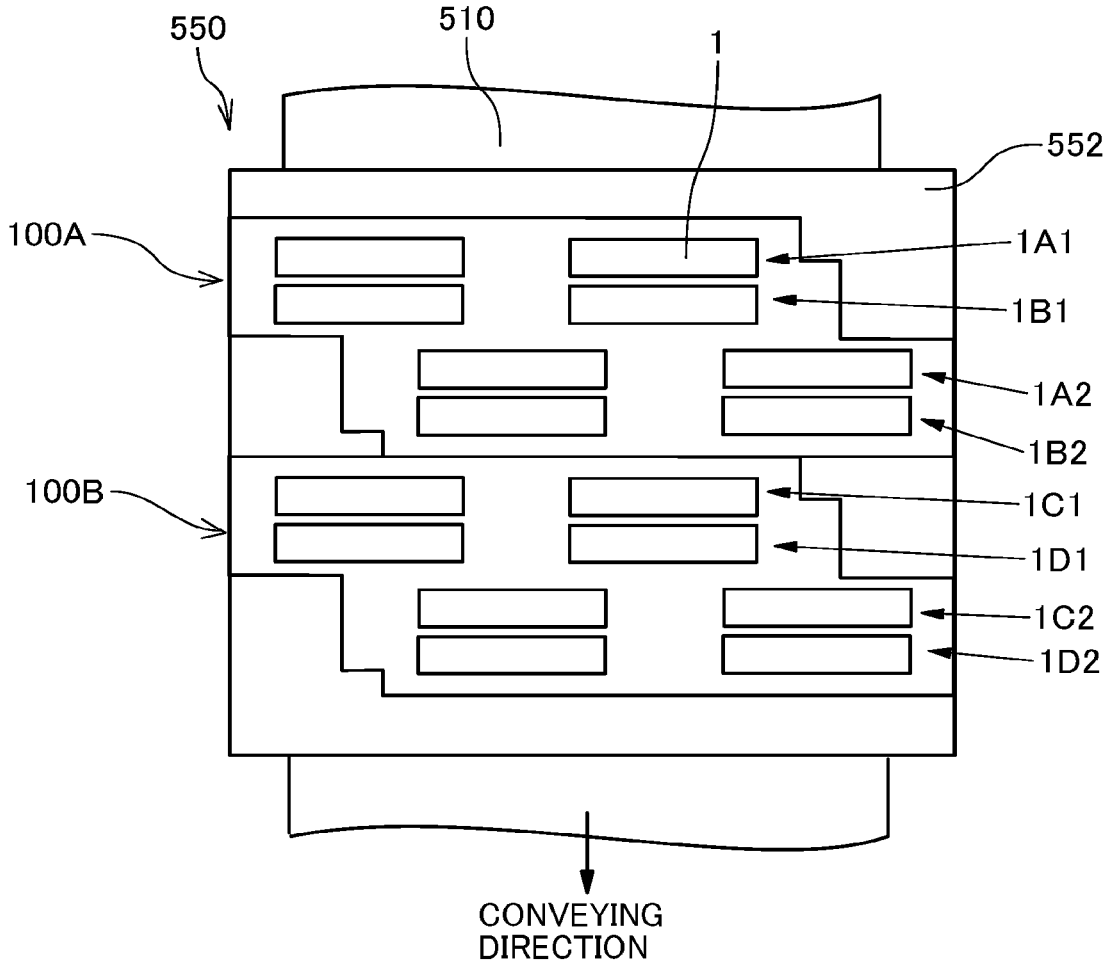
FIG. 13 is a plan illustrative view of an example of a head unit of the apparatus.

Next, a liquid discharge apparatus according to an embodiment of the present disclosure is described with reference to FIGS. 12 and 13. FIG. 12 is a schematic illustrative diagram of the apparatus, and FIG. 13 is a plan illustrative view of an example of a head unit of the apparatus.

A printing apparatus 500 being the liquid discharge apparatus includes a loader 501 for loading a continuous body 510, a guiding conveyor 503 for guiding and conveying the continuous body 510 loaded from the loader 501 to a printer 505, the printer 505 that print to discharge liquid to the continuous body 510 to form an image, a dryer 507 that dries the continuous body 510, and an unloader 509 that unloads the continuous body 510.

The continuous body 510 is sent out from an original wind roller 511 of the loader 501, guided to be conveyed by rollers of the loader 501, the guiding conveyor 503, the dryer 507, and the unloader 509 to be wound up by a wind-up roller 591 of the unloader 509.

The continuous body 510 is conveyed so as to be opposed to a head unit 550 and an image is printed thereon by the liquid discharged from the head unit 550 in the printer 505.

Herein, the head unit 550 includes two head modules 100A and 100B according to an embodiment of the present disclosure arranged side by side on a common base member 552.

Assuming that an array direction of the heads 1 in a direction orthogonal to a conveying direction of the head module 100 is a head array direction, liquid of the same color is discharged by head rows 1A1 and 1A2 of the head module 100A. Similarly, head rows 1B1 and 1B2 of the head module 100A are made a set, head rows 1C1 and 1C2 of the head module 100B are made a set, and head rows 1D1 and 1D2 are made a set, and each of them discharges liquid of a required color.

Figure 14:
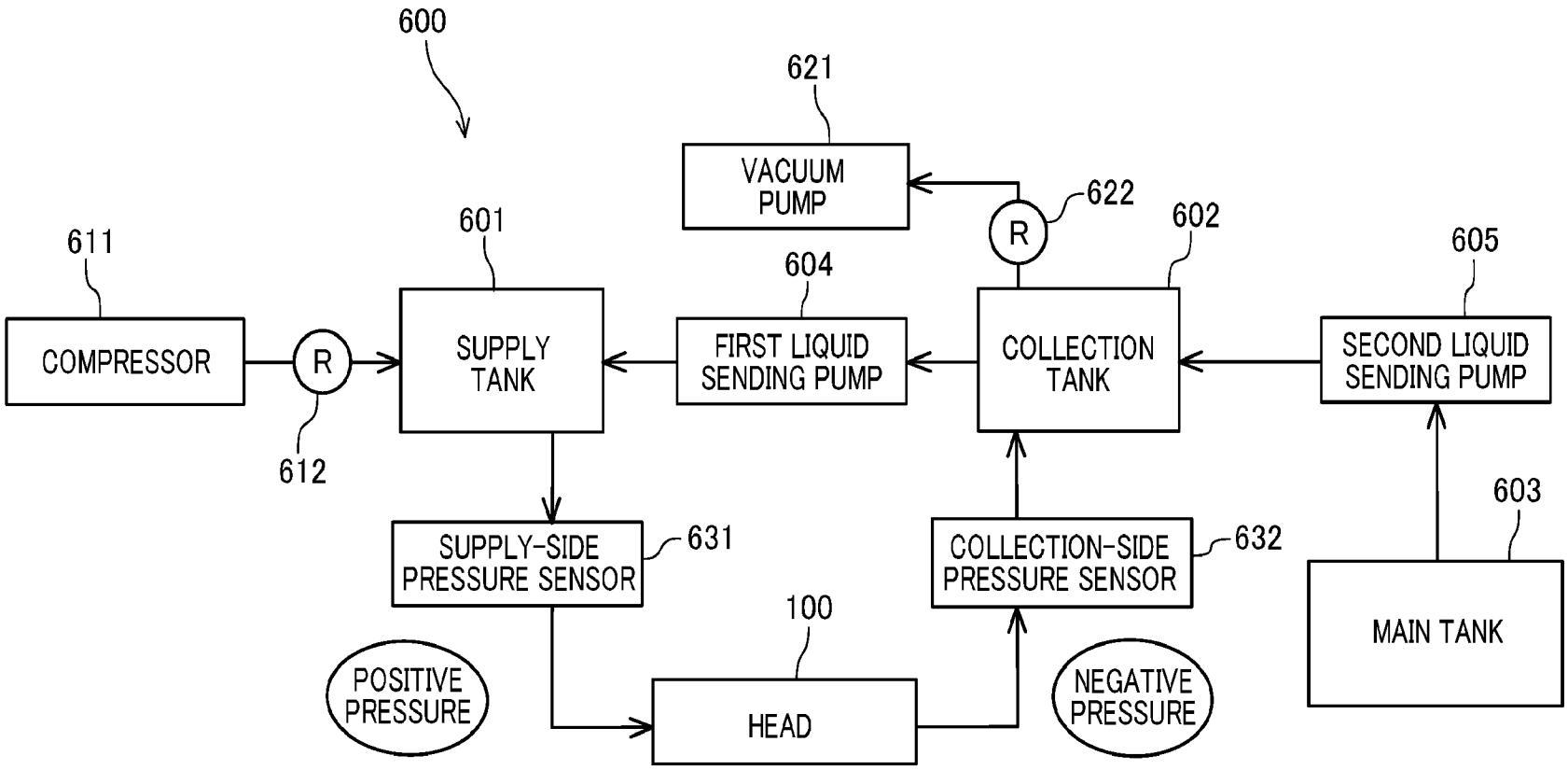
FIG. 14 is a block illustrative diagram of an example of a liquid circulation device.

Next, an example of a liquid circulation device is described with reference to FIG. 14. FIG. 14 is a block illustrative diagram of the liquid circulation device. Although one head is herein illustrated, in a case where a plurality of heads is arrayed, a supply-side liquid path and a collection-side liquid path are connected to a supply side and a collection side, respectively, of the plurality of heads via a manifold and the like.

A liquid circulation device 600 includes a supply tank 601, a collection tank 602, a main tank 603, a first liquid sending pump 604, a second liquid sending pump 605, a compressor 611, a regulator 612, a vacuum pump 621, a regulator 622, a supply-side pressure sensor 631, and a collection-side pressure sensor 632.

Herein, the compressor 611 and the vacuum pump 621 form a device for generating a differential pressure between a pressure in the supply tank 601 and a pressure in the collection tank 602.

The supply-side pressure sensor 631 is connected between the supply tank 601 and the head 1, connected to the supply-side liquid path connected to a supply port 81 of the head 1. The collection-side pressure sensor 632 is connected between the head 1 and the collection tank 602, connected to the collection-side liquid path connected to a collection port 82 of the head 1.

One side of the collection tank 602 is connected to the supply tank 601 via the first liquid sending pump 604, and the other side of the collection tank 602 is connected to the main tank 603 via the second liquid sending pump 605.

As a result, the liquid flows from the supply tank 601 through the supply port 81 into the head 1, collected from the collection port 82 to the collection tank 602, and transferred from the collection tank 602 to the supply tank 601 by the first liquid sending pump 604, so that a circulation path through which the liquid circulates is formed.

Herein, the compressor 611 is connected to the supply tank 601 to be controlled such that a predetermined positive pressure is detected by the supply-side pressure sensor 631. The vacuum pump 621 is connected to the collection tank 602 to be controlled such that a predetermined negative pressure is detected by the collection-side pressure sensor 632.

As a result, a meniscus negative pressure may be kept constant while allowing the liquid to circulate through the head 1.

When the liquid is discharged from a nozzle 11 of the head 1, an amount of liquid in the supply tank 601 and the collection tank 602 decreases. Therefore, the liquid is replenished from the main tank 603 to the collection tank 602 using the second liquid sending pump 605 as appropriate.

A liquid replenishing timing from the main tank 603 to the collection tank 602 may be controlled by a detection result of a liquid level sensor and the like provided in the collection tank 602; for example, when a level of the liquid in the collection tank 602 falls below a predetermined height, the liquid is replenished.

Figure 15:
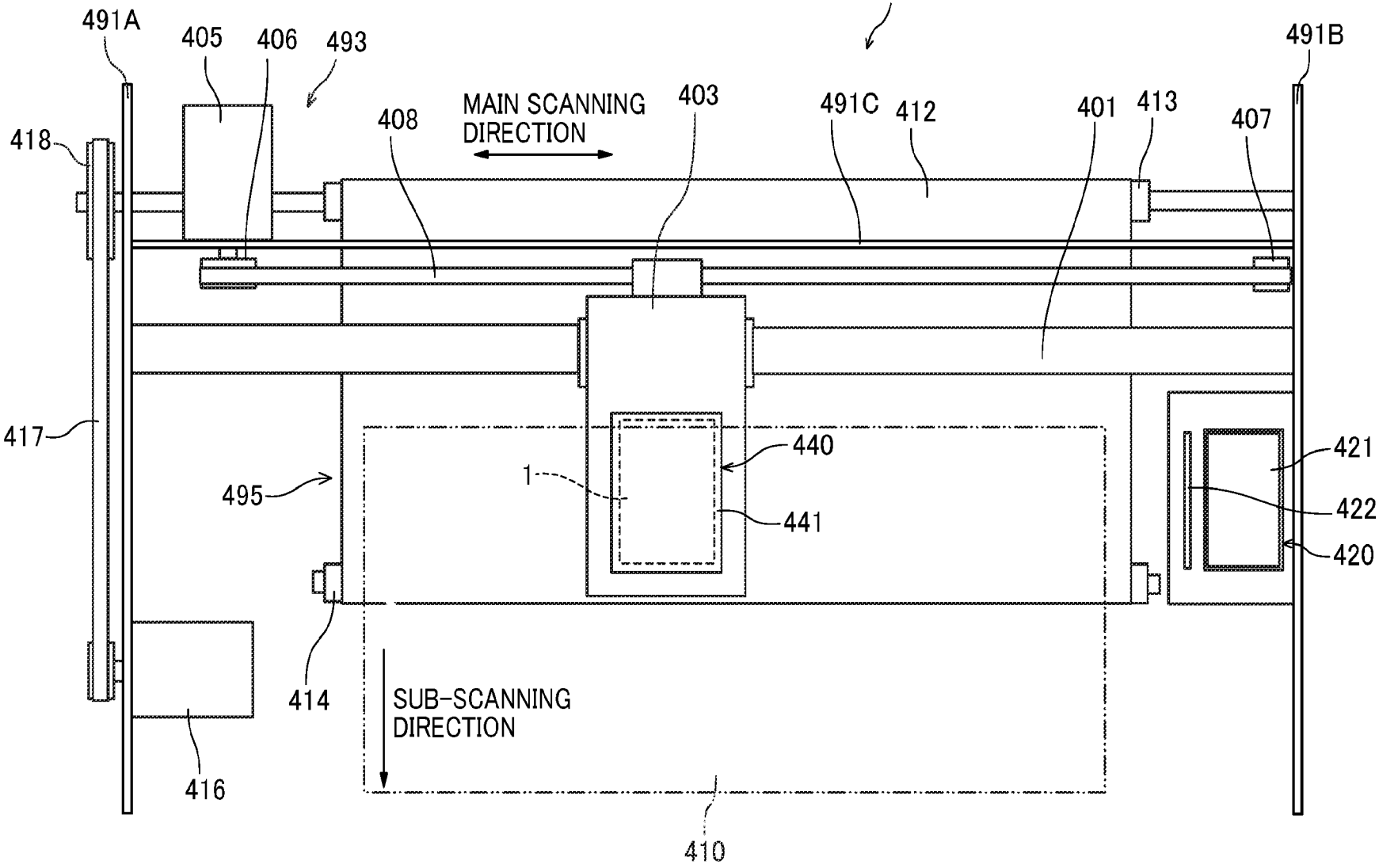
FIG. 15 is a plan illustrative view of a substantial part of another example of a printing apparatus as a liquid discharge apparatus according to an embodiment of the present disclosure.
Figure 16:
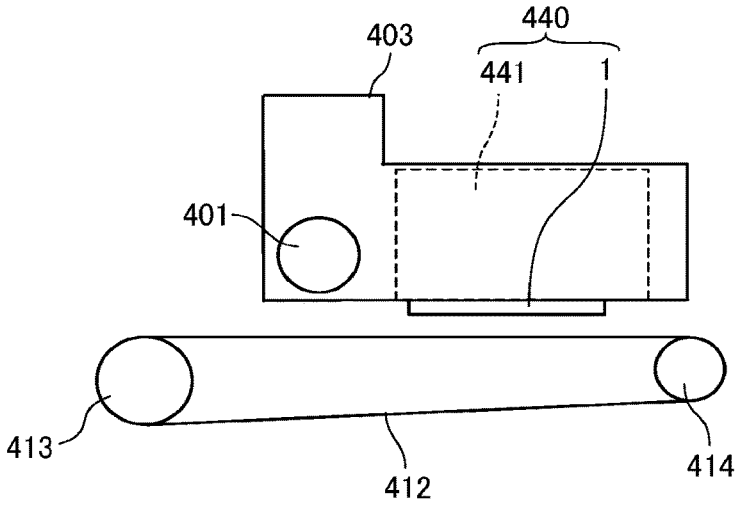
FIG. 16 is a side illustrative view of a substantial part of the apparatus.

Next, another example of a printing apparatus as a liquid discharge apparatus according to an embodiment of the present disclosure is described with reference to FIGS. 15 and 16. FIG. 15 is a plan illustrative view of a substantial part of the apparatus, and FIG. 16 is a side illustrative view of the substantial part of the apparatus.

A printing apparatus 500 is a serial type apparatus in which a carriage 403 is reciprocated in a main-scanning direction by a main-scanning movement mechanism 493. The main-scanning movement mechanism 493 includes a guide member 401, a main-scanning motor 405, a timing belt 408 and the like. The guide member 401 is stretched over left and right side plates 491A and 491B to hold the carriage 403 so as to be movable. The carriage 403 is reciprocated in the main-scanning direction via the timing belt 408 stretched between a driving pulley 406 and a driven pulley 407 by the main-scanning motor 405.

The carriage 403 is equipped with a liquid discharge device 440 in which the head 1 which is a droplet discharge head according to an embodiment of the present disclosure and a head tank 441 are integrated. The head 1 of the liquid discharge device 440 discharges liquids of respective colors of yellow (Y), cyan (C), magenta (M), and black (K), for example. The liquid discharge head 1 is mounted with a nozzle row including a plurality of nozzles arrayed in a sub-scanning direction orthogonal to the main-scanning direction such that a discharge direction is a direction downward.

The liquid discharge head 1 is connected to the liquid circulation device 600 described above, and the liquid of a required color is circulated to be supplied.

The printing apparatus 500 includes a conveyance mechanism 495 for conveying paper 410. The conveyance mechanism 495 includes a conveyor belt 412 serving as a conveyor, and a sub-scanning motor 416 for driving the conveyor belt 412.

The conveyor belt 412 attracts the paper 410 and conveys the same in a position opposed to the head 1. The conveyor belt 412 is an endless belt and is stretched between a conveyor roller 413 and a tension roller 414. The attraction may be electrostatic attraction or air suction.

When the conveyor roller 413 is rotationally driven by the sub-scanning motor 416 via a timing belt 417 and a timing pulley 418, the conveyor belt 412 rotates to move in the sub-scanning direction.

A maintenance/recovery mechanism 420 that maintains and recovers the liquid discharge head 1 is disposed at the side of the conveyor belt 412 on one side in the main-scanning direction of the carriage 403.

The maintenance/recovery mechanism 420 includes, for example, a cap member 421 for capping a nozzle surface of the head 1 and a wiper member 422 for wiping the nozzle surface.

The main-scanning movement mechanism 493, the maintenance/recovery mechanism 420, and the conveyance mechanism 495 are attached to a casing including side plates 491A and 491B and a back plate 491C.

In the printing apparatus 500 configured in this manner, the paper 410 is fed to be attracted onto the conveyor belt 412, and the paper 410 is conveyed in the sub-scanning direction by rotary movement of the conveyor belt 412.

By driving the head 1 according to an image signal while moving the carriage 403 in the main-scanning direction, the liquid is discharged onto the paper 410 which stops to form an image.

Figure 17:
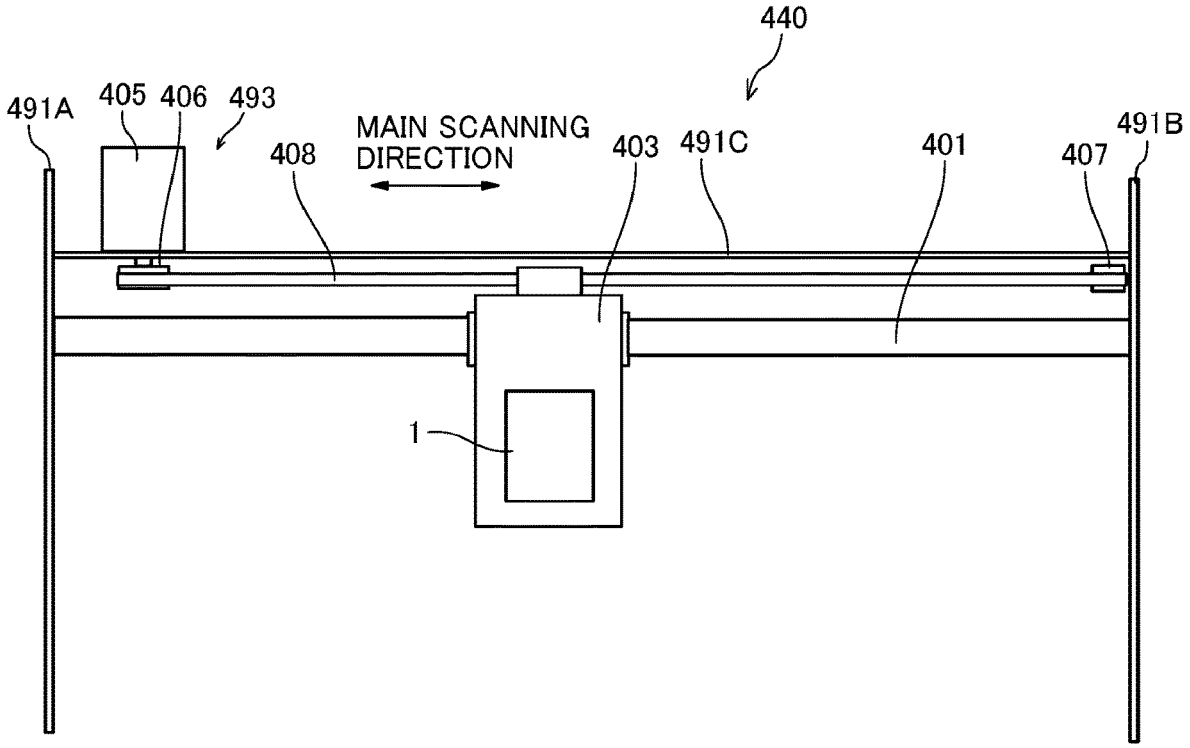
FIG. 17 is a plan illustrative view of a substantial part of another example of a liquid discharge device according to an embodiment of the present disclosure.

Next, another example of the liquid discharge device according to an embodiment of the present disclosure is described with reference to FIG. 17. FIG. 17 is a plan illustrative view of a substantial part of the liquid discharge device.

The liquid discharge device 440 is formed of a casing portion formed of the side plates 491A and 491B and the back plate 491C, the main-scanning movement mechanism 493, the carriage 403, and the head 1 out of members forming the liquid discharge apparatus described above.

A liquid discharge device obtained by further attaching the above-described maintenance/recovery mechanism 420 to, for example, the side plate 491B of the liquid discharge device 440 may also be formed.

Figure 18:
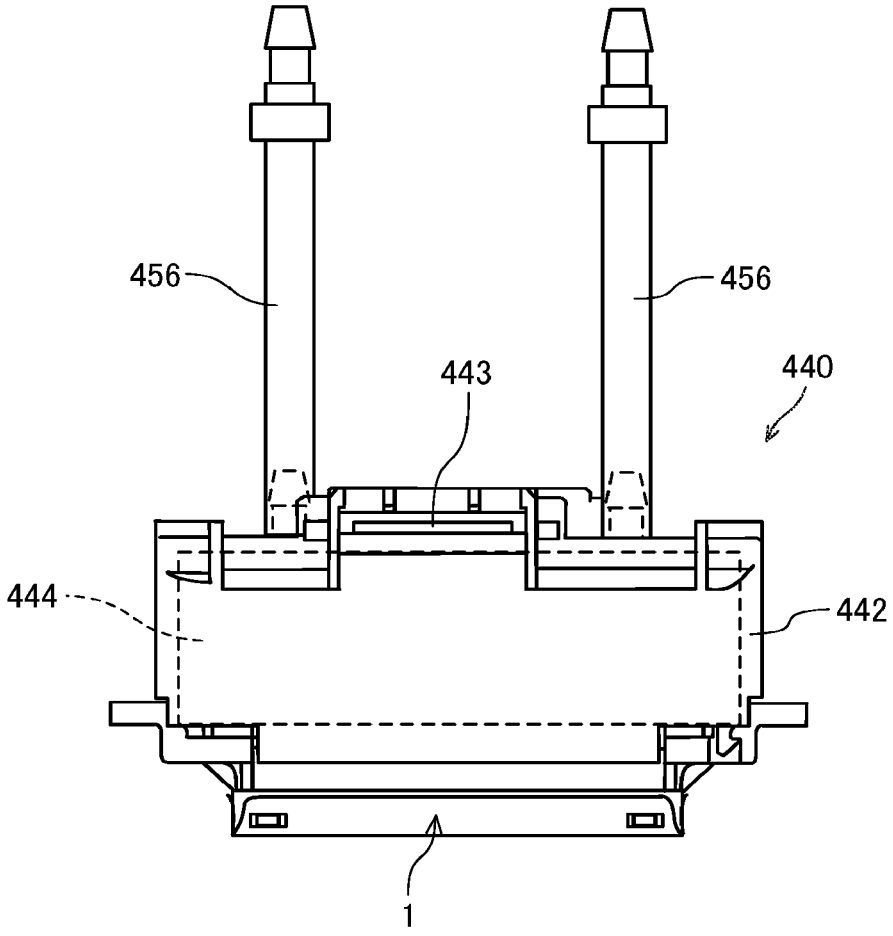
FIG. 18 is a front illustrative view of still another example of the liquid discharge device according to an embodiment of the present disclosure.

Next, still another example of the liquid discharge device according to an embodiment of the present disclosure is described with reference to FIG. 18. FIG. 18 is a front illustrative view of the liquid discharge device.

The liquid discharge device 440 includes the head 1 to which a channel component 444 is attached and a tube 456 connected to the channel component 444.

The channel component 444 is disposed inside a cover 442. A head tank 441 may also be included in place of the channel component 444. A connector 443 electrically connected to the liquid discharge head 1 is provided above the channel component 444.

In the present application, the discharged liquid is not limited in particular as long as this has viscosity and surface tension such that this may be discharged from the head, but the viscosity is preferably 30 mPa·s or less at room temperature under a normal pressure, or by heating and cooling. More specifically, the liquid includes solutions, suspensions, emulsions or the like including solvents such as water and organic solvents, colorants such as dyes and pigments, functional materials such as polymerizable compounds, resins, and surfactants, biocompatible materials such as deoxyribonucleic acid (DNA), amino acids, proteins, and calcium, and edible materials such as natural pigments; they may be used as, for example, inkjet inks, surface treatment liquids, forming liquids of components of electronic elements and light emitting elements, and electronic circuit resist patterns, and three-dimensional fabricating material liquids.

As energy generation sources for discharging the liquid, piezoelectric actuators (multilayer piezoelectric elements and thin film piezoelectric elements), thermal actuators using electrothermal transducers such as heating resistors, electrostatic actuators formed of a diaphragm and counter electrode are included.

The "liquid discharge device" is obtained by integrating a functional component and a mechanism with the liquid discharge head, and this includes an assembly of components relating to liquid discharge. For example, the "liquid discharge device" includes a combination of the liquid discharge head with at least one of configurations of a head tank, a carriage, a supply mechanism, a maintenance/recovery mechanism, a main-scanning movement mechanism, and a liquid circulation device.

Examples of integrating herein include securing of the liquid discharge head, functional component, and mechanism by fastening, bonding, or engaging, and holding of one so as to be movable with respect to the other. The liquid discharge head, functional component, and mechanism may also be detachably attached to one another.

Examples of the liquid discharge device include the one in which the liquid discharge head and the head tank are integrated. There also is the one in which the liquid discharge head and the head tank are connected to each other with a tube or the like to be integrated. A unit including a filter may also be herein added between the head tank and the liquid discharge head of the liquid discharge device.

Examples of the liquid discharge device include the one in which the liquid discharge head and the carriage are integrated.

Examples of the liquid discharge device also includes the one in which a guide member forming a part of the main-scanning movement mechanism is allowed to movably hold the liquid discharge head and the liquid discharge head and the main-scanning movement mechanism are integrated. There also is the one in which the liquid discharge head, the carriage, and the main-scanning movement mechanism are integrated.

Examples of the liquid discharge device also include the one in which a cap member which forms a part of a maintenance/recovery mechanism is secured to the carriage to which the liquid discharge head is attached, and the liquid discharge head, the carriage, and the maintenance/recovery mechanism are integrated.

There also is the liquid discharge device in which a tube is connected to the liquid discharge head to which the head tank or a channel component is attached, and the liquid discharge head and the supply mechanism are integrated. Liquid in a liquid storage source is supplied to the liquid discharge head via the tube.

The main-scanning movement mechanism also includes a single piece of guide member. The supply mechanism also includes a single piece of tube or charger.

The "liquid discharge device" is herein described in combination with the liquid discharge head, but the "liquid discharge device" also includes the one obtained by integrating the head module or the head unit including the above-described liquid discharge head with the above-described functional component and mechanism.

The "liquid discharge apparatus" includes an apparatus that includes the liquid discharge head, the liquid discharge device, the head module, the head unit and the like, and drives the liquid discharge head to discharge the liquid. Examples of the liquid discharge apparatus include not only an apparatus capable of discharging the liquid to a material to which the liquid may adhere but also an apparatus which discharges the liquid toward gas or into liquid.

The "liquid discharge apparatus" may include devices of feeding, conveying, and ejecting the material to which the liquid may adhere and also include a pre-treatment device and a post-treatment device.

For example, examples of the "liquid discharge apparatus" include an image forming apparatus which discharges ink to form an image on paper, and a stereoscopic fabrication apparatus (three-dimensional fabrication apparatus) which discharges fabrication liquid to a powder layer obtained by forming powder into a layer for fabricating a stereoscopic fabrication object (three-dimensional fabrication object).

The "liquid discharge apparatus" is not limited to an apparatus which visualizes a meaningful image such as a character and a figure by the discharged liquid. For example, an apparatus which forms a meaningless pattern, or an apparatus which fabricates a three-dimensional image are also included.

The "material to which the liquid may adhere" described above is intended to mean the material to which the liquid may adhere at least temporarily, the material to which the liquid adheres to be fastened, or the material to which the liquid adheres to permeate. Specific examples include recording media such as paper, recording paper, paper for recording, a film, and cloth, electronic components such as an electronic substrate and a piezoelectric element, and media such as a powder layer (powder layer), an organ model, and a testing cell. All the materials to which the liquid adheres are included unless limited in particular.

Materials of the above-described "material to which the liquid may adhere" may be any material as long as the liquid may adhere thereto even if temporarily such as paper, thread, fiber, cloth, leather, metal, plastic, glass, wood, and ceramics.

The "liquid discharge apparatus" includes an apparatus in which the liquid discharge head and the material to which the liquid may adhere move relative to each other; however, this is not limited to such an apparatus. Specific examples include a serial type apparatus in which the liquid discharge head is moved, and a line type apparatus in which the liquid discharge head is not moved.

The "liquid discharge apparatus" also includes a processing liquid applying apparatus which discharges a processing liquid onto paper for applying the processing liquid to a surface of the paper for the purpose of modifying the surface of the paper, an injection granulating apparatus which injects a composition liquid obtained by dispersing row materials in solution through a nozzle to granulate raw material fine particles and the like.

The terms of "image formation", "recording", "printing", "fabrication" and the like used in this application are synonyms.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a plurality of pressure chambers communicated with a plurality of nozzles configured to discharge liquid, respectively;

a plurality of individual supply channels communicated with the plurality of pressure chambers, respectively;

a plurality of common supply channel branches, each of which is communicated with two or more individual supply channels of the plurality of individual supply channels;

a common supply channel mainstream communicated with the plurality of common supply channel branches;

a plurality of individual collection channels communicated with the plurality of pressure chambers, respectively;

a plurality of common collection channel branches, each of which is communicated with two or more individual collection channels of the plurality of individual collection channels;

a common collection channel mainstream communicated with the plurality of common collection channel branches;

a supply-side filter in the common supply channel mainstream; and a bypass channel bypassing the supply-side filter and communicating the common supply channel mainstream with the common collection channel mainstream, the bypass channel being connected to the common supply channel mainstream at a downstream of the supply-side filter in a direction of flow of the liquid along a longitudinal direction of the common supply channel mainstream.

2. The liquid discharge head according to claim 1, further comprising a collection-side filter in the common collection channel mainstream.

3. The liquid discharge head according to claim 1, further comprising another bypass channel connected to the common supply channel mainstream at an upstream of the supply-side filter in the direction of flow of the liquid along the longitudinal direction of the common supply channel mainstream.

4. The liquid discharge head according to claim 1, further comprising a damper member including a displaceable wall surface facing the common supply channel branches, wherein the damper member is provided with the supply-side filter.

5. The liquid discharge head according to claim 1, wherein a channel cross-sectional area of the bypass channel is larger than an opening of the supply-side filter.

6. A head module comprising an array of a plurality of liquid discharge heads, including the liquid discharge head according to claim 1.

7. A head unit comprising a plurality of head modules, including the head module according to claim 6, arranged side by side.

8. A liquid discharge apparatus comprising the head unit according to claim 7.

9. A liquid discharge apparatus comprising the head module according to claim 6.

10. A liquid discharge device comprising the liquid discharge head according to claim 1.

11. The liquid discharge device according to claim 10, wherein the liquid discharge head is integrated as a single unit with at least one of:

a head tank configured to store the liquid to be supplied to the liquid discharge head;

a carriage on which the liquid discharge head is mounted;

a supply mechanism configured to supply the liquid to the liquid discharge head;

a maintenance recovery device configured to perform maintenance and recovery of the liquid discharge head; and a main-scanning moving mechanism configured to move the liquid discharge head in a main scanning direction.

12. A liquid discharge apparatus comprising the liquid discharge device according to claim 10.

13. A liquid discharge apparatus comprising the liquid discharge head according to claim 1.

14. A liquid discharge head comprising:

a plurality of pressure chambers communicated with a plurality of nozzles configured to discharge liquid, respectively;

a common supply channel communicated with the plurality of pressure chambers;

a common collection channel communicated with the plurality of pressure chambers; and a supply-side filter in the common supply channel; and a bypass channel bypassing the supply-side filter and communicating the common supply channel with the common collection channel, the bypass channel being connected to the common supply channel at a downstream of the supply-side filter in a direction of flow of the liquid along a longitudinal direction of the common supply channel.

15. The liquid discharge head according to claim 14, further comprising a collection-side filter in the common collection channel.

16. The liquid discharge head according to claim 14, further comprising another bypass channel connected to the common supply channel at an upstream of the supply-side filter in the direction of flow of the liquid along the longitudinal direction of the common supply channel.

* * * * *